United States Patent [19]

Gunnergaard et al.

[11] 4,079,774

[45] Mar. 21, 1978

[54] SYSTEM FOR MAKING SAND MOLDS EACH HAVING ASSOCIATED THEREWITH A CORE MEMBER

[75] Inventors: Marius Gunnergaard, Lyngby; Hemming Kristian Jorgensen, Klampenborg, both of Denmark

[73] Assignee: Dansk Industri Syndikat A/S, Herley, Denmark

[21] Appl. No.: 740,734

[22] Filed: Nov. 10, 1976

Related U.S. Application Data

[63] Continuation of Ser. No. 482,828, Jun. 25, 1974, abandoned.

[30] Foreign Application Priority Data

Jun. 25, 1973 United Kingdom ..... 30151/73

[51] Int. Cl.[2] ..... B22C 13/12; B22C 25/00

[52] U.S. Cl. ..... 164/28; 164/137; 164/186; 164/227; 164/340; 425/468

[58] Field of Search ..... 164/28, 186, 180, 169, 164/213, 227, 228, 340, 137; 425/468

[56] References Cited

U.S. PATENT DOCUMENTS

| | | | |
|---|---|---|---|
| 3,327,767 | 6/1967 | Wallwork | 164/186 X |
| 3,424,229 | 1/1969 | Gunnergaard et al. | 164/137 X |
| 3,802,485 | 4/1974 | Popov et al. | 164/137 X |

FOREIGN PATENT DOCUMENTS

| | | |
|---|---|---|
| 21,823 | 6/1971 | Japan. |

*Primary Examiner*—Francis S. Husar
*Assistant Examiner*—Gus T. Hampilos
*Attorney, Agent, or Firm*—Fleit & Jacobson

[57] ABSTRACT

A system for making sand molds each having associated therewith a core member composed of a core element or a network of core elements is disclosed. The system includes a machine for making and depositing onto a conveyor, mold sections having joint faces in engagement to form a string of closed-up mold sections. Each mold section has a mold cavity defined in its joint face. A core making machine is positioned adjacent the string of closed-up mold sections and include at least two core box sections, each having a joint face and being arranged for mating of their joint faces for molding a core member therebetween. One of the core box sections retains the mold core member when the faces of the core box sections are parted. The core box section is placed into an orientation such that its joint face is parallel with the exposed face of the last mold section. A core mask is provided for fetching the core member from the core box section and transferring the core member to the last mold section. Translatory means are provided for moving the core mask between a core picking up position where it engages with the core box section while its joint face is parallel with the exposed joint face of the last mold section, and a core delivery position where it engages the exposed joint face of the last mold.

17 Claims, 12 Drawing Figures

SYSTEM FOR MAKING SAND MOLDS EACH HAVING ASSOCIATED THEREWITH A CORE MEMBER

This is a continuation of application Ser. No. 482,838, filed June 25, 1974, now abandoned.

This invention relates broadly to foundry practice and more particularly to a system for making sand molds each having associated therewith a core member composed of a core element or a network of core elements.

Still more particularly the invention relates to a system of the type comprising a machine for successively making and depositing onto a conveyer mold sections with their joint faces in engagement to form a string of closed-up mold sections with mold cavities defined between adjacent mold sections and with the last mold section exposed preparatory to being engaged with a joint face of the next to be formed mold section.

A system of this type is shown and described in the U.S. Pat. No. 3,424,229. This known system further comprises a core mask which is movable in two steps from a core receiving position, in which the core member can be placed in the core mask, to a position opposite the rearmost mold section of the string and from there in the axial direction of the string for inserting the core member into the mold section. In one embodiment of this system the core mask is mounted on the end of an arm which is pivotable about an axis parallel to the string of molds and besides displaceable in the direction of that axis. However, the posibility of moving the core mask along a rectilinear transverse path is also contemplated. The insertion of the core member in the core mask is normally made by hand but may also be performed mechanically, although it is not explained in the patent specification how such a mechanical insertion can take place.

The prior art also comprises an automatic molding plant disclosed in U.S. Pat. No. 3,327,767, which, like the present system, includes a machine for making mould sections with mould cavities in two opposed side faces and positioning the mould sections closed up in a string and which further comprises a core making machine with a core box which is so disposed adjacent to the moulds that one core box section with the cores formed therein by performing partly a rotating movement, partly a swinging movement and partly an axial displacement can be caused to transmit the cores directly to the last mould section of the string. In this known system the movable core box section thus performs the same function as the core mask of the system dealt with here. The necessity of the core box section performing, besides a swinging movement and an axial displacement, also a rotating movement is caused by the fact that the core box is disposed horizontally during the shooting of the cores while the mould faces to which the cores are to be transmitted are vertical.

The operating speed of this known system is limited by the fact that the core box is precluded from being used for its primary purpose, i.e., production of cores, during all of the time, it takes for one core box section to move to the mold, deliver the core member to said mold and return to the other core box section. Furthermore, heavily dimensioned machine parts are required to support the heavy core box section and control its movement with the necessary high degree of exactness. The heavy parts thus to be moved require a correspondingly high power in order that the movements shall take place with a reasonable speed.

It is the object of the present invention to provide an automatically working system of the aforesaid type which, compared with the prior art, is of lesser weight, cheaper in operation, has a lower power consumption and is able to work faster.

The system according to the present invention comprises, in addition to the features already mentioned, a core making machine positioned adjacent said string of closed-up mold sections and including at least two core box sections, each having a joint face and being arranged for mating of their joint faces for molding a core member therebetween, one of said core box sections retaining the mold core member when the joint faces of the core box sections are parted, said one core box section being adapted to be placed into an orientation such that its joint face is parallel with the exposed joint face of the last mold section, a core mask for fetching the core member and transferring the core member to the last mold section, and translatory means for moving the core mask between a core picking up position where it engages with said core box section while its joint face is parallel with the exposed joint face of the last mold section and a core insertion position where it engages the exposed joint face of the last mold.

In this system the core mask is an active device which fetches the core member holding the one core box section and transfers it to sections, and releasing a core member last formed mold section in order to finally insert the core member into the exposed mold cavity of said mold section. The core box is available for shooting and hardening of the cores for a much greater part of the working period than in the prior art system, no core box section being used for core transport. The core mask may be considerably lighter than a core box section and therefore requires less heavy and material-consuming structural members for support and control. The reduction of the masses involved also means a reduction of power comsumption.

The fact that the core network is first transferred from one core box section to the core mask and then from the core mask to the mould section involves the additional advantage that both sides or ends of the core members are visible and accessible during the transfer procedure so that possible errors may be detected and fins removed.

A preferred embodiment of the system according to the present invention comprises two core box sections fixed together in back-to-back relationship and arranged for rotation, a cooperating core box section being provided adjacent said fixed two core box sections, said cooperating core box section being arranged for alternative mating with said fixed two core box sections as said fixed core box sections are rotated. This arrangement makes possible a further reduction of the time period during which the core box is open.

Other features and advantages of the invention will appear from the following description with reference to the drawing, in which FIG. 1 is a schematic presentation of the individual steps of the working cycle of an embodiment of the system according to the invention with the illustrated parts viewed from above.

Figure 1:
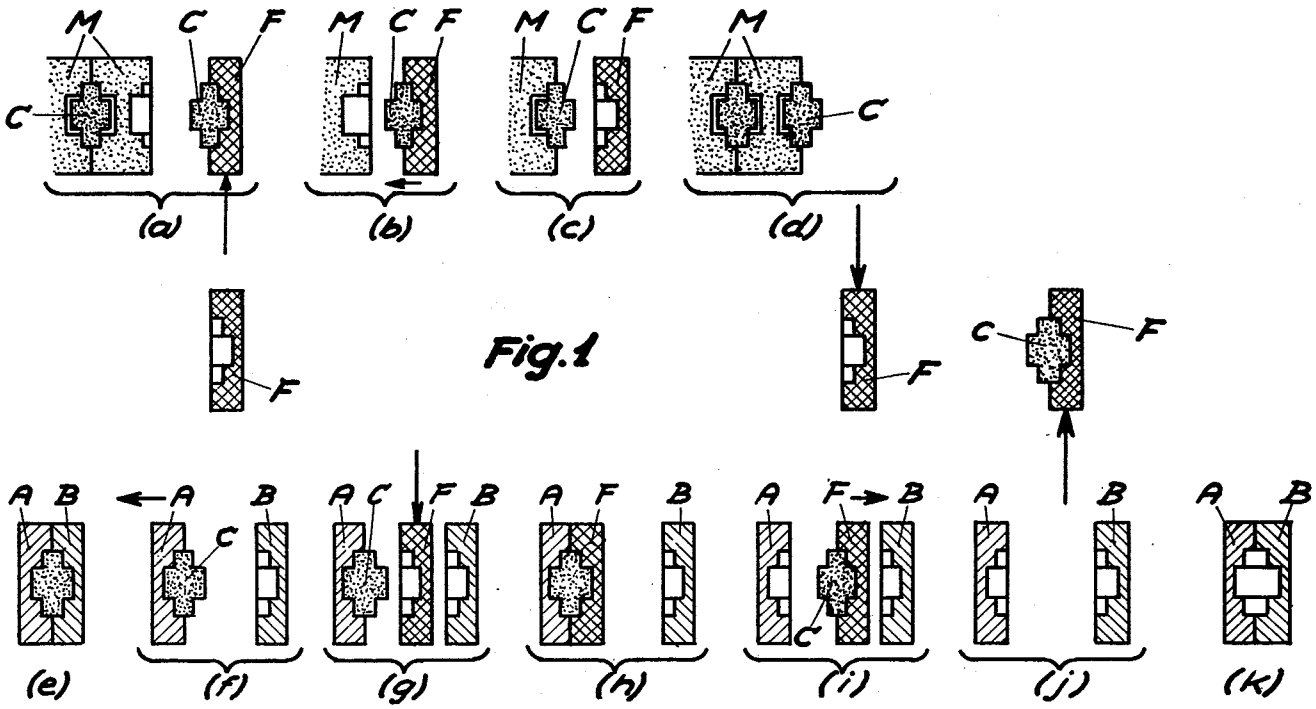

In FIG. 1 (a)–(k), M is a sand mould section made in conventional manner and comprising two moulding cavities in two opposed vertical side faces, each mould being formed by the two cavities facing each other in two closed up mould sections of the mould string shown in FIG. 1(a) and (d). The upper mould string (a)–(d) in FIG. 1 shows the individual steps of placing the core C in a mould by means of a core mask F, which, in a manner that will be described later, is movable both in its axial direction and in the horizontal direction perpendicular thereto. By the axis of the core mask is here to be understood a line perpendicular to the center of the vertical side faces. Correspondingly, the axis of the mould sections 14 is a line perpendicular to the center of the vertical moulding faces. The same definition of the axis obtains with respect to the core box comprising two sections A and B and indicated in FIG. 1 (e) –(k), which illustrates the individual steps of the opening and closing movements of the core box sections during the production of the core C and the withdrawal of the produced core by means of the core mask F. The core mask can assume a holding position midway between the mould string and the core box, the axes of which are parallel.

In many cases a mould shall contain not one core but, as indicated in FIG. 1, a network of cores interconnected by shooting lines. However, such a core network may be treated in the same way as a single core.

In FIG. 1(a) the core mask F with the core C retained therein has been positioned by a transverse movement, indicated by an arrow, in alignment with the rearmost mould section m of the string of moulds. In FIG. 1(b) the core mask has initiated its axial movement, indicated by an arrow, towards the mould section, and in FIG. 1(c) it is moving away from the mould section after having inserted the core C therein. In FIG. 1(d) the core mask has been carried to the holding position to make room for the next mould section which is pushed towards the mould string, pushing the string towards the left by the thickness of one mould section.

FIG. 1(c) shows a finished core C made in the core box formed by the two closed up sections A and B. In FIG. 1(f) the core box section A carrying the core is moved axially so far away from the section B, indicated by an arrow, that the core mask F can be introduced beween the two sections, as indicated in FIG. 1(g). Then the core mask F is moved axially towards the core box section A, as indicated in FIG. 1(h) and backwards carrying the core as indicated in FIG. 1(i). In FIG. 1(j) the core mask with the core is withdrawn from the space between the two core box sections and on its way to the position shown in FIG. 1(a) to deliver the core to the last deposited mould section M. In FIG. 1(k) the core box section A is again closed up with section B and the core box ready for the shooting of a new core.

Figure 2:
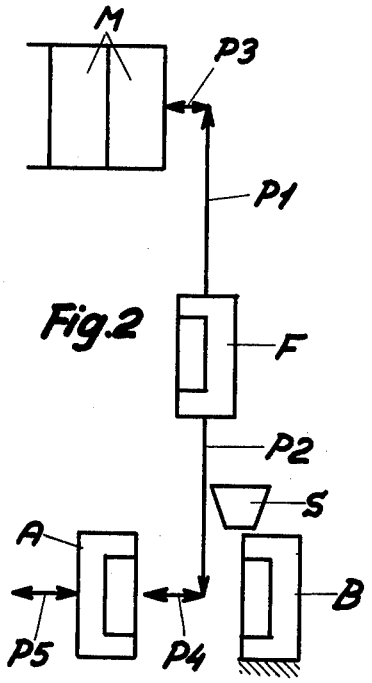
FIG. 2 illustrates schematically an embodiment of the invention having a fixed and axially movable core box section with a core mask movable transversely and axially.

A system operating as described above is illustrated schematically in FIG. 2, which uses the same reference symbols M. F. A and B as in FIG. 1 to designate the mold sections, the core mask and the two core box sections. A sand shooting unit is shown at S. The transverse movements of the core mask from the holding position to the mould string and the core box are indicated by two arrows, P1 and P2 respectively, and its reciprocating axial movement opposite the mould string and between the separated core box sections is indicated by double arrows, P3 and P4 respectively. The axial movement of the core box section A away from and towards the second box section B is indicated by a double arrow P5.

Changes in the described pattern of movement of the core mask and the core box are possible. For instance, the axial movements of the core mask between the core box sections can be replaced by axial movements of the already movable core box section. And section A may be fixed and section B movable instead of vice versa. If desired, both sections A and B may be axially movable.

Figure 3:
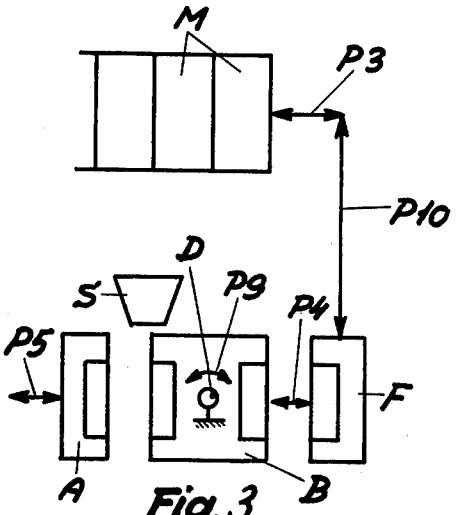
FIG. 3 illustrates schematically an embodiment of the invention having a rotatable core box section having two molding faces.

In the embodiment of the system illustrated in FIG. 3 is used a core box section B which is mounted rotatably about a vertical shaft D, as indicated by a curved double arrow P9, and which has moulding cavities in two opposite facing side faces, one of which faces the second core box section A, which is axially displaceable, as indicated by P5, while the other faces the core mask F in its receiving position, the core mask being axially displaceable as indicated by P4, P 10 indicates the transverse movements of the core mask.

When a core has been produced and hardened in the core box formed by section A and the adjoining end of section B, the core box is opened by axial displacement of section A, following which section B is rotated 180° about the shaft D so as to being the core in a position opposite the core mask F in which it can be transmitted thereto by axial displacement thereof and the empty moulding cavity is positioned in alignment with the core box section A. Section A is then returned to section B so that a new core can be made simultaneously with the transmission of the last produced core to the mould section M by means of the core mask F. Thus the working period is very short.

The rotatable core box section may be provided with a plurality of side faces with moulding cavities, facing in different directions and defining a prism, specifically a three-sided prism. Another possible modification of the system shown in FIG. 3 consists in replacing the axial movements of the core box section A and the core mask F opposite the rotatable section B by axial displacements of the latter, i.e. the bearing blocks of the shaft D are mounted displaceably in guides extending parallel to the axis of the fixed core box section A. Also a combination of these two constructions will be possible, and furthermore the rotation shaft of the rotatable core box section may be horizontal instead of vertical.

Figure 4:
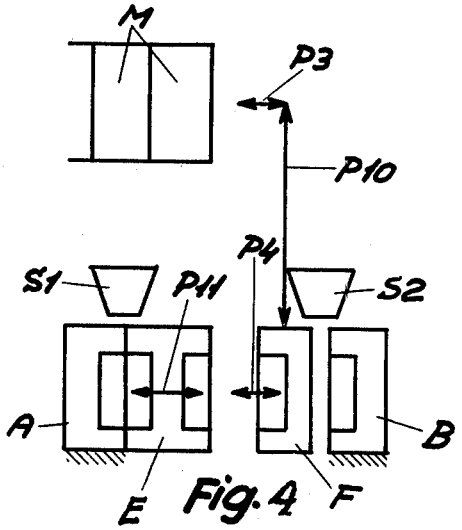
FIG. 4 illustrates schematically an embodiment of the invention having two stationary core box sections and one axially reciprocable core box section with two molding faces.

The embodiment of the system shown in FIG. 4 comprises two alternately working core boxes consisting of two stationary core box sections A and B and a core box section E reciprocating axially therebetween and having a moulding cavity in both sides facing their respective fixed sections. The two core boxes have their separate shooting units, S1 and S2 respectively. The movements of the section E are indicated by the double arrow P11 and the movements of the core mask F by P3, P4 and P10. It will be seen that the core mask is to be introduced alternately on one and on the other side of the core box section E, and that it will be able to transmit the last made core from the core box to the mould section M simultaneously with the making of the new core in the second core box.

Figure 5:
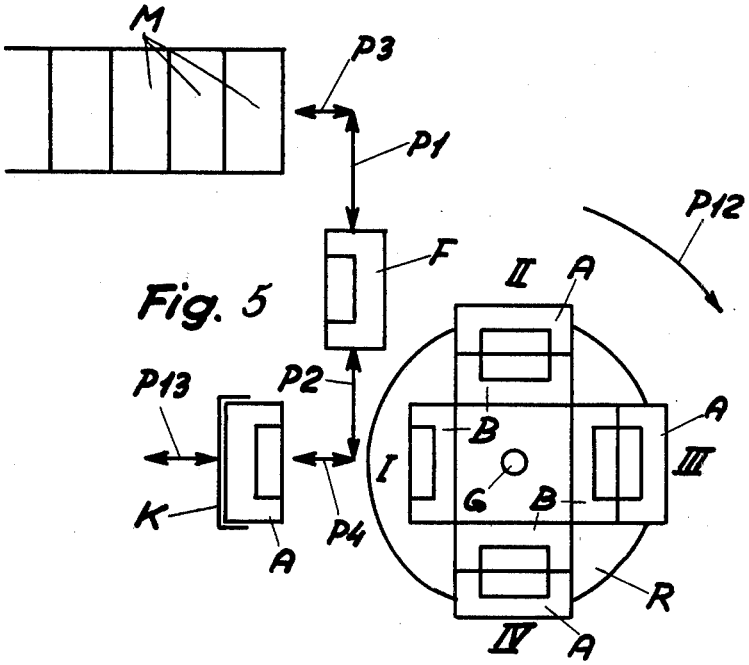
FIG. 5 illustrates schematically an embodiment of the invention having a plurality of rotatable core box sections.

The system illustrated in FIG. 5 is provided with four core boxes A, B which are mounted on a roundabout R rotatable about a vertical shaft G so that the axis of each core box forms a radius of the roundabout. During the rotation of the roundabout, which is performed in steps of 90° in the direction indicated by the arrow P12, each core box passes four stations I, II, III and IV. At station 1 both withdrawal of the finished core and sand shooting of a new core may be effected. At the other stations II, III and IV both hardening and venting may be effected. On account of the relatively long time available for these procedures it will be possible to make large cores.

The axial movements of each core box section A at Station I indicated by the double arrow P13 are effected by means of a bracket K adapted to be coupled to sections A as they arrive at station K.

There may be mounted both fewer and more than four cores boxes on the roundabout R. And, obviously, the shooting of the core need not be performed at the same station as the withdrawal.

Figure 6:
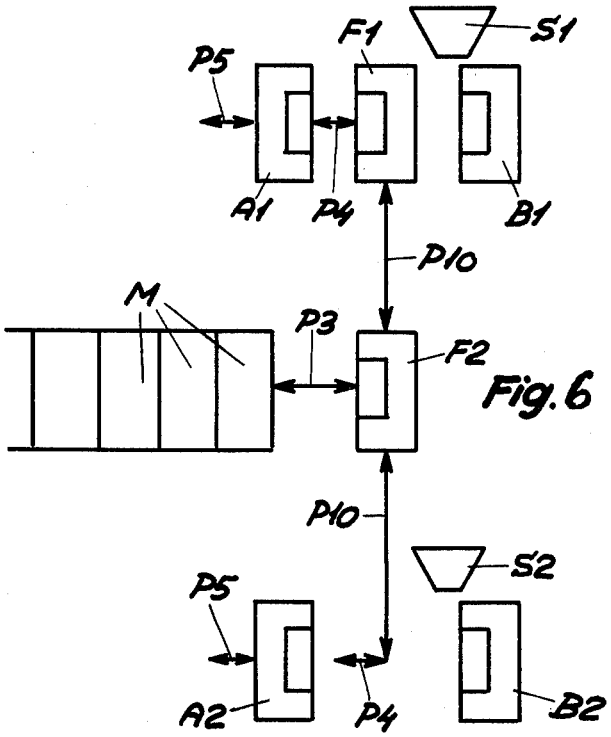
FIG. 6 illustrates schematically an embodiment of the invention showing plural core masks.

The system illustrated in FIG. 6 has a core making machine on either side of the string of moulds. One machine has a core box A1, B1 and a sand shooting unit A1 while the other machine has a core box A2, B2 and a sand shooting unit S2. Each machine has its core mask, F1 and F2 respectively, which however are able to work alternately on the same transverse guides. The two core masks may be coupled together or adapted to be coupled together. It will also be possible to let a single core mask serve both core boxes.

Figure 7:
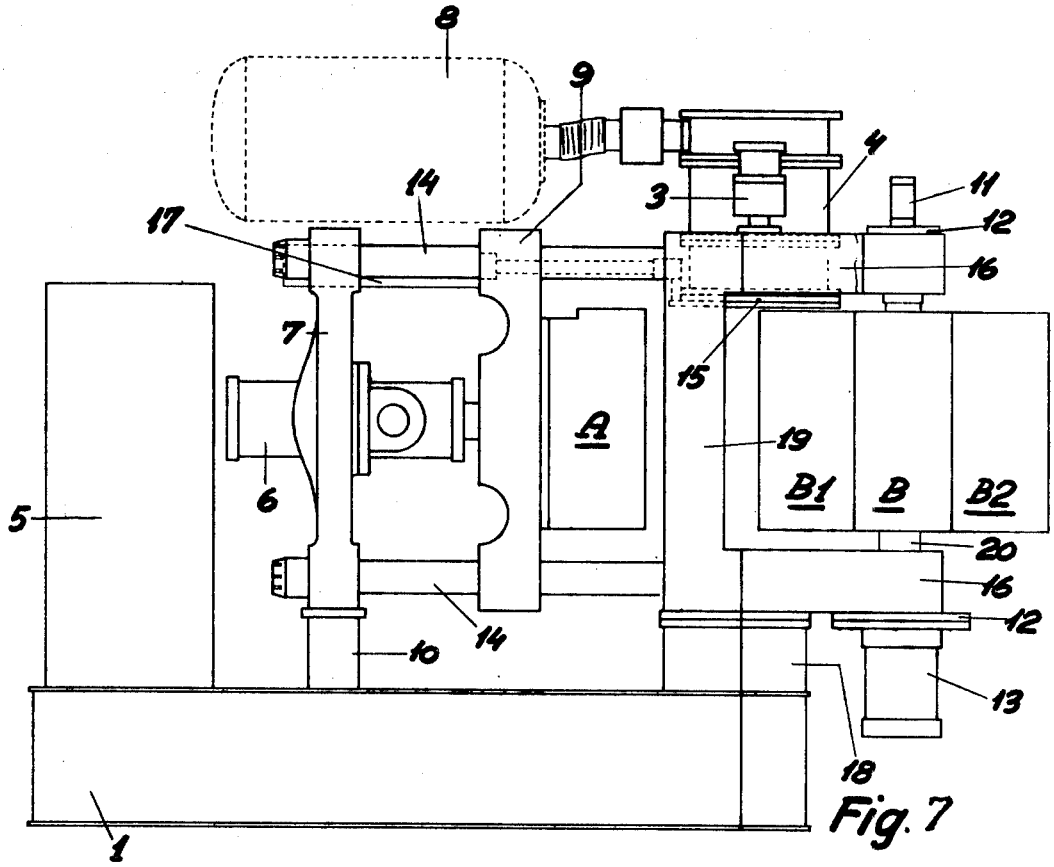
FIGS. 7 and 8 show a core making machine of the type used as component of the system illustrated in FIG. 3, viewed from the side and from above respectively.
Figure 8:
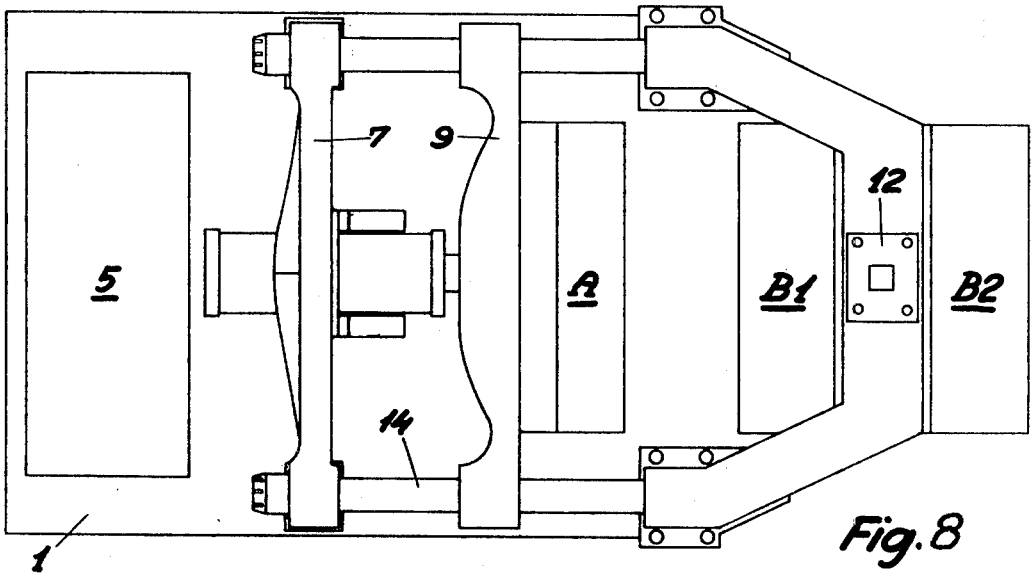

FIGS. 7 and 8 illustrates the structural build-up of a core making machine of the type shown in FIG. 3 and having a rotatable core box section with moulding cavities in two opposed side faces.

The machine is mounted on a base frame 1 and supported by two supports 10 and two supports 18. The latter carries a frame comprising two vertical posts 19 on either side of the machine and two approximately U-shaped bridging members 16 connecting the posts 19 with each other at the top and at the bottom. In the centre of the outwardly facing bottom section of each bridging member 16 is mounted a bearing 12 for a vertical shaft 20 supporting a rotatable core box section B with two opposed core box halves B1 and B2. A hydraulic rotating cylinder 13 mounted on the underside of the lower bridging member 16 serves to rotate the shaft 20 and the section B.

The supports 10 carry a fixed bracket 7 which in turn supports one end of four guides 14 for a movable bracket 9 mounted thereon, the said guides being supported at the other end by the posts 19. The fixed bracket moreover supports a hydraulic cylinder 6 the piston rod of which is connected to the movable bracket 9, which can thus be displaced on the guides 14 by activation of the cylinder 6. The movable bracket 9 supports the core box section A, which can thus be moved into engagement with and removed from the inwardly facing core box section half B1 or B2.

FIG. 7 further shows a sand shooting unit 4 which can be raised and lowered by means of two hydraulic cylinders mounted on their respective sides of the unit and connected with a sand hopper (not shown) and a compressed air container 8. At 15 is shown a gas supply plate which when the sand shooting unit 4 has been raised can be inserted into engagement with the upper surface of the core box by means of a pneumatic cylinder 17. This gas supply plate 15 is adapted to feed a hardening catalyst to the core from a source which is not shown here. 5 is a ventilation apparatus and 11 is a pneumatic cylinder mounted on the upper end of the shaft 20 and serving in a known but not shown manner to activate a not shown push-out arrangement in the outwardly facing core box half section B1 or B2 when the core is to be transmitted therefrom to the core mask.

A working cycle of the machine is started by the cylinder 6 being activated to carry the core box section A into engagement with the inwardly facing half section, here B1, on the rotatable core box section B. The gas supply plate 15 has been removed, and the sand shooting unit 4 is lowered towards the upper surface of the new closed core box A, B1 by activation of the cylinders 3. After completion of the sand shooting the unit 4 is raised again and the gas supply plate 15 is introduced by means of the cylinder 17. After hardening the gas supply plate is removed and the movable bracket 9 with the core box section A is withdrawn and leaves the finished core in the half core box B1. Now the core box section B is turned 108° and there is again two empty core box halves facing each other and the machine is ready for a new working cycle. While the new cycle proceeds the core mask fetches the prepared core and transmits it to the last deposited mould in the string.

Figure 9:
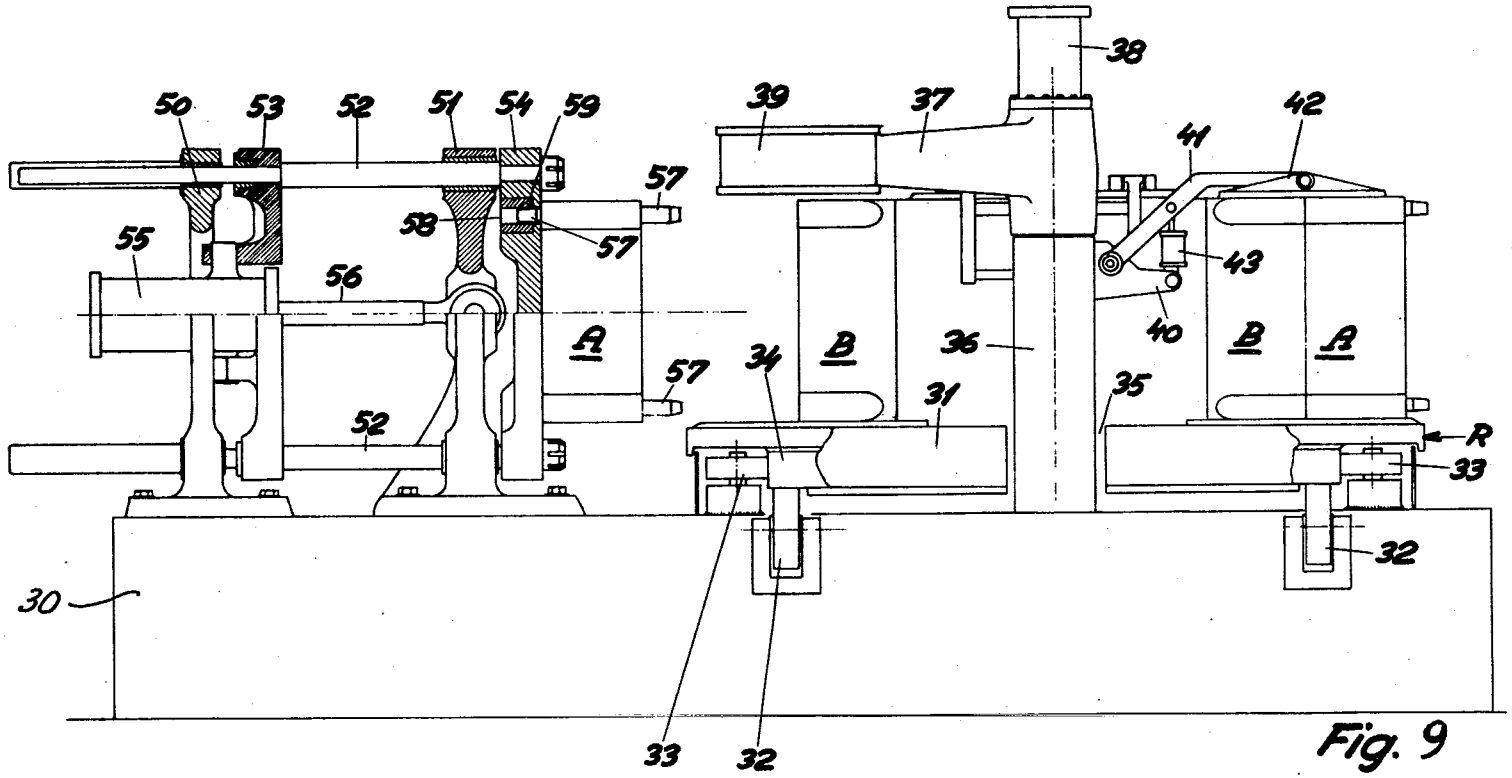
FIGS. 9 and 10 show a core making machine of the type used as component in the system illustrated in FIG. 5, viewed from the side and from above respectively.
Figure 10:
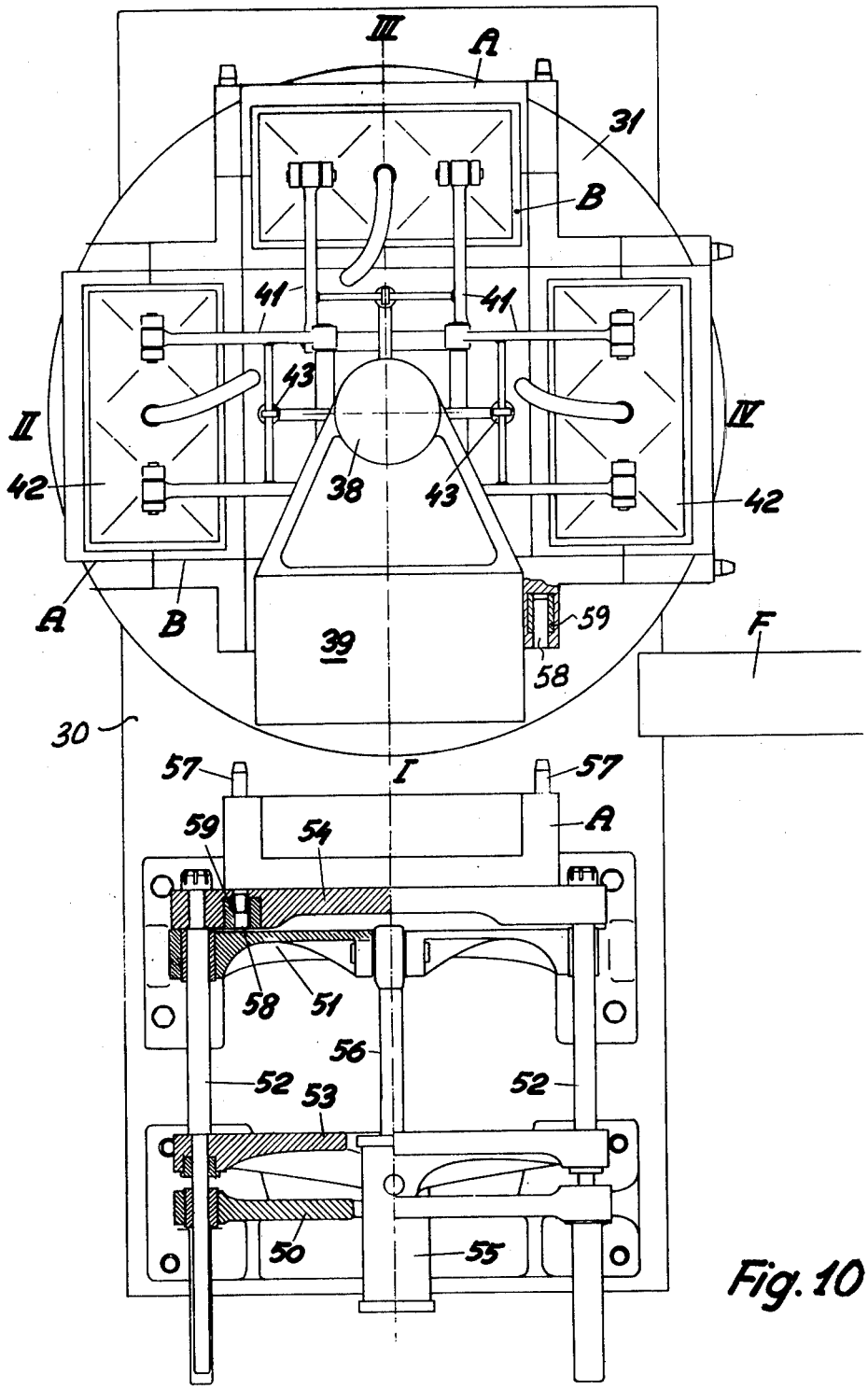

FIGS. 9 and 10 illustrate the structural build-up of a core making machine of the type shown in FIG. 5 and comprising four core boxes mounted in a roundabout.

The machine is mounted on a base frame 30. The roundabout R is a round table 31, the underside of which is supported along the periphery on a plurality of rollers 32 which are rotatable about horizontal axes and spaced at regular intervals in the base frame 30 at one end thereof. The table 31 is controlled radially by a plurality of likewise regularly spaced rollers 33 rotatable about vertical axes and abutting on a cylindrical shoulder face 34 on the table 31. The table may in any suitable, not shown, manner be rotated by steps of 90° by means of a preferably hydraulic drive mechanism disposed in the base frame 30. It will also be possible to rotate the table by means of a motor coupled to one or more of the rollers 32.

On top of the table 31 are mounted four core boxes A, B, which are so disposed that their axes form radii perpendicular to each other. The table 31 has a central aperture 35 through which a column 36 extends upwardly from the base frame 30. On this column is mounted an arm 37 which is displaceable a certain distance in the axial direction of the column by means of a hydraulic cylinder 38 and which on its outer end supports a sand shooting unit 39, which can thus be lowered towards and raised from the core box situated at station K. At its top the column moreover supports three brackets 40 in which one end of three radial pairs of arms 41 are pivotally mounted. By their outer ends the arms support and are rotatably connected to their respective gas supply plates 42. Each pair of arms can be activated by means of a cylinder 43 which is rotatably connected to the corresponding bracket 40 and the piston rod of which is rotatably connected to a connecting rod between the arms of the pair.

At the other end of the base frame 30 are mounted two fixed brackets 50 and 51 forming guides for four guide rods 52 which are rigidly connected to two movable brackets 53 and 54, the innermost of which 54 is named the delivery bracket because it is used to remove the outer core box section A from the inner section B at station I to enable the core mask entering between the sections to collect the core. To the outer movable bracket 53 is secured a hydraulic cylinder 55 the piston rod 56 of which is rotatably connected to the inner rigid bracket 51. By activation of this cylinder the movable brackets 53 and 54 can be reciprocated and the whole bracket arrangement is disposed so that this movement is performed in the axial direction of the core box positioned at station I.

Each of the outer core box sections A has on each side four guide pins 57 in their respective corners for engagement with matching apertures 58 partly in the inner core section B and partly in the inner movable bracket 54. Each of the apertures is enclosed by a magnetizing coil 59 which on excitation will tend to attract the corresponding guide pin 57 into the coil and retain it there.

From the position indicated in FIGS. 9 and 10 a working cycle is started by the delivery bracket with the empty core box section A moving forward towards the opposed empty section B on the roundabout so that the core box is closed up. The sand shooting unit 39 is lowered by activation of the cylinder 38, the core is shot and the shooting unit is again raised. The coils of the delivery bracket are demagnetized and simultaneously the coils of the core box section B at station I are magnetized so that the two core box halves are held together, whereafter the delivery bracket 54 is withdrawn without core box section.

The roundabout R is now turned 90°, whereby the core box with the just shot core is carried beneath the gas supply plate 42 at station II. This gas supply plate 42 is lowered towards the core box by activation of the corresponding cylinder 43 and catalyst is added. If the core is so large that additional hardening is required this may be done at the following station III. At station IV and possibly also at station III clean air is blown into the core so as to cleanse it of catalyst before it is introduced into the mould.

When the roundabout is turned 90° a core box A, B with a finished core will move forward in front of the delivery bracket 54. The bracket moves forward towards the core box and the coils in section B are demagnetized while the coils in the delivery bracket 54 are magnetized. When the bracket 54 is then withdrawn it carries the core box section A so that the core box is opened and afford space for the core mask F to collect the finished core and deliver it to the mould section in the string of moulds.

After removal of the core mask the machine is ready to start a new working cycle. To avoid impeding the core mask it may be desirably that the arm 37 that supports the sand shooting unit 39 should be mounted pivotally on the column 36 so that the unit can swing outwards while the core mask collects the finished core.

Figure 11:
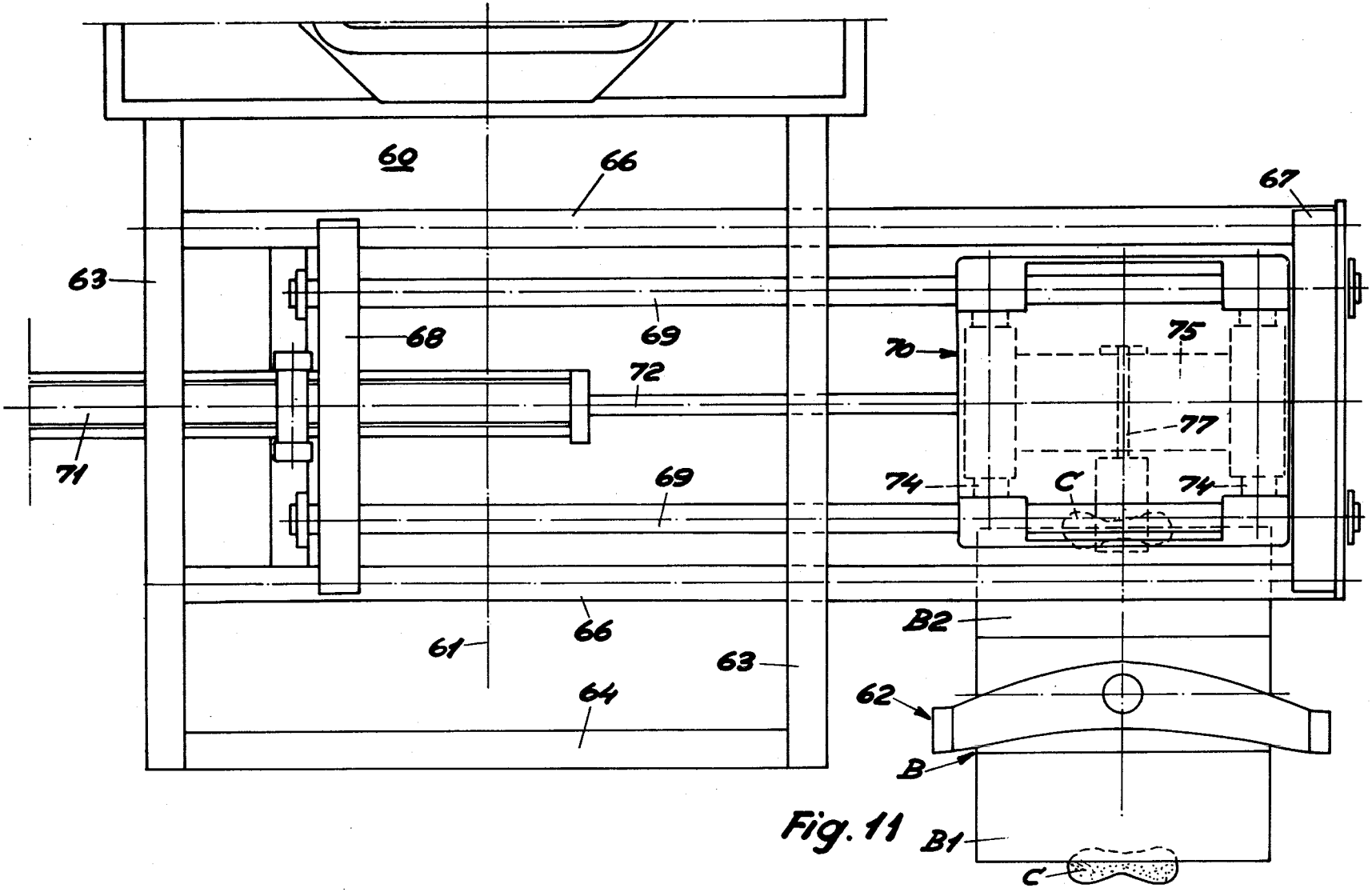
FIG. 11 is a horizontal picture showing the combination of a machine for making a string of moulds and a core making machine of the type illustrated in FIGS. 7 and 8, the moving means and guide means for the core mask.
Figure 12:
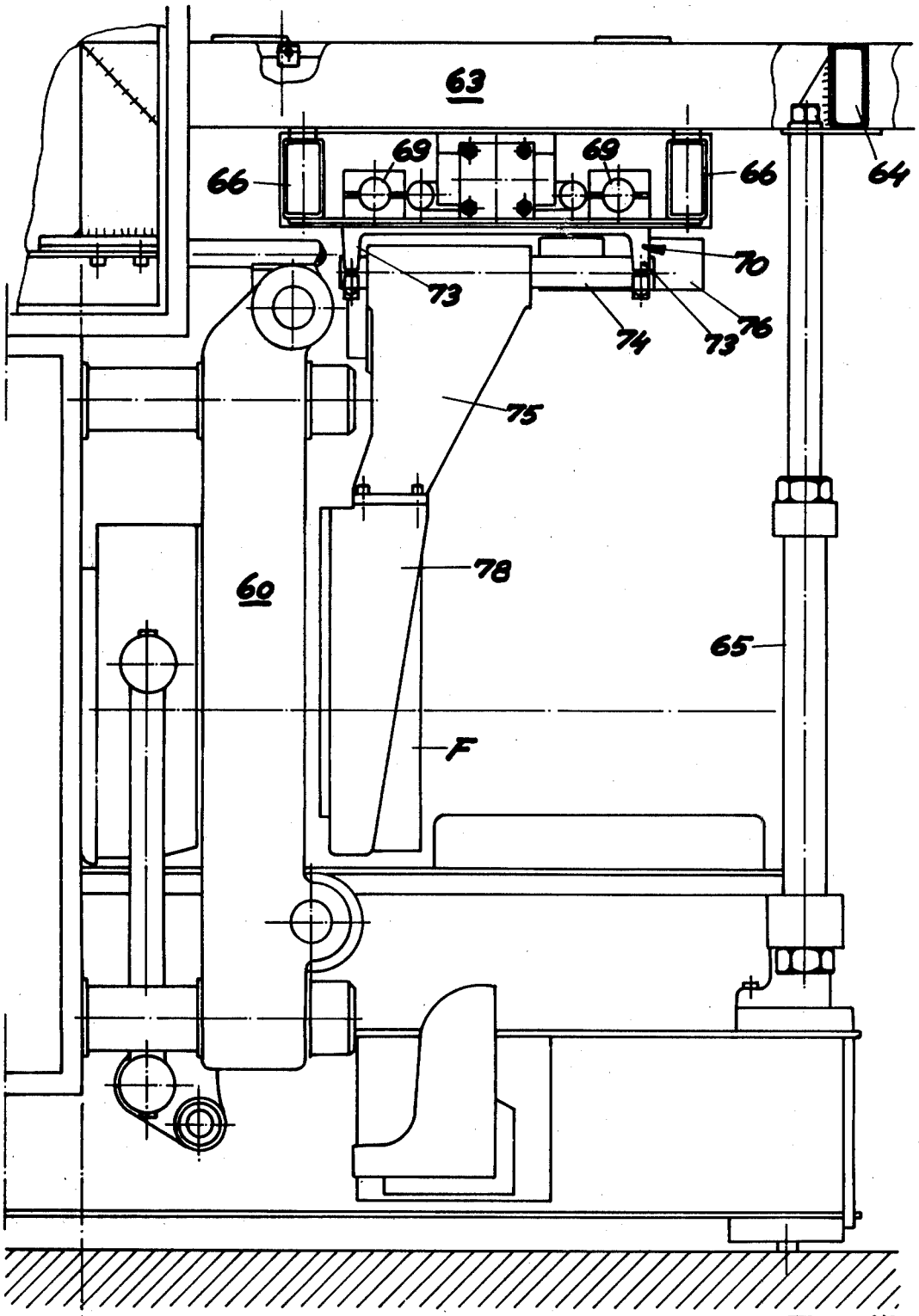
FIG. 12 is a vertical picture viewed from the left in FIG. 11.

FIGS. 11 and 12 exemplify how the translatory movements of the core mask can be generated and controlled. In these figures 60 denotes the front end of a machine of the type that makes sand mould sections with mould cavities in two opposed side faces and as they are made pushes them on to a guide rail, which is not shown in the drawing but which is symmetrical about the axis 61.

Beside and parallel to that guide rail is provided a core making machine 62, which here is of the type having a rotatable core box section B with two opposed core box halves B1 and B2 as shown in FIGS. 7 and 8 and more schematically in FIG. 3.

At the top of the mould making machine is mounted an upper frame comprising two longitudinal girders 63 and a transverse girder 64 which are further supported by two corner posts 65. To the underside of the longitudinal girders 63 is secured a lower frame comprising two transverse girders 66 extending over the core making machine 62 where their outer ends are connected by means of a girder 67. Adjacent to their inner ends the transverse girders 66 are connected by means of a girder 68. Between the girders 67 and 68 are clamped two guides 69 for a slide 70 which can be reciprocated on the guiders by means of a pneumatic cylinder 71 secured to the girder 68 and whose piston rod 72 is secured to the slide 70. At each end of the slide between downwardly extending flanges 73 thereon are clamped two guides 74 parallel to the axis 61 for guiding a bracket 75 which is displaceable on the said guides by means of a pneumatic cylinder 76 which is secured to the slide 70 and whose piston rod 77 is secured to the bracket 75. To the lower end of the bracket 75 is secured a frame 78 in which the core mask F is releasably mounted.

While the slide 70 is in the position indicated in FIG. 11, mould section is pushed out from the machine 60 along the axis 61 on to the conveyor grate (not shown) where it displaces the string of mould sections already deposited thereon so that the last arriving mold section is placed behind the transverse path of movement of the core mask F. Simultaneously the rotatable core box section B has been turned so that the core box half B2 with the last produced core C faces the core mask F. The mask is now by activation of the cylinder 76 carried towards the core box section to fetch the core C therefrom, on which the bracket 75 with the core mask is again withdrawn on the guides 74. On activation of the cylinder 71 the slide 70 with bracket and core mask is pulled over the conveyor grate, whereby the core mask and the core deposited therein are positioned in alignment with the rearmost mould section of the mould string so that the core can be inserted therein by renewed activation of the cylinder 76 and the axial movement of the bracket 75 and the core mask F towards the mould section thereby produced by the cylinder. When the core has been delivered the bracket and the core mask are withdrawn and the slide 70 is again pushed into the position indicated in FIG. 11 with the core mask aligned with the core box section B, and a new working cycle can start.

The core making machine with rotatable core box section illustrated in FIG. 11 can be replaced directly by any of the other core making machines described above.

The structural details of the systems illustrated and described here can be modified in many ways within the scope of the present invention.

What we claim is:

1. A method for making sand molds each having associated therewith a core member composed of a core element or a network of core elements comprising the steps of a. making mold sections having parallel joint faces with mold cavities in each joint face, b. depositing the mold sections consecutively onto a conveyor such that the joint faces of each mold section are in engagement with an adjacent mold section to form a string of mold sections, c. making core members at a position adjacent said string of mold sections by i. providing a first and second core box section each having a joint face with a cavity therein, ii. moving said first and second core box sections into mating engagement with each other such that the cavities form a mold, iii. molding a core member within the mold formed by said core box sections, iv. separating said first and second core box sections while retaining the core member in the second core box section, v. positioning said second core box section so that its joint face is parallel with the joint face of the last deposited mold section, d. providing a core mask for removing a core from the second core box section, holding the core during transfer to the string of mold sections, and releasing a core member into the last deposited mold section, e. moving the core mask into engagement with the second core box section after the second core box section is positioned such that its joint face is parallel with the joint face of the last deposited mold section, and obtaining the core member from the second core box section, f. transferring the core mask to the last deposited mold section, g. moving said core mask into engagement with the joint face of the last deposited mold section, and depositing said core member in the mold cavity of said last deposited mold section.

2. The method of claim 1 further comprising providing the second core box section with first and second joint faces mounted in back-to-back relationship and parallel to each other and rotating said second core box section at 180° increments.

3. The method of claim 2 further comprising the steps of moving the first core box section into engagement with the first joint face of the second core box section, molding a core member within the mold formed by the first core box section and the first joint face of the second core box section, separating the first core box section from the first joint face of the second core box section, rotating the second core box section 180°, moving the core mask into engagement with the first joint face of the second core box section after it is rotated to obtain the core member from the first joint face, and simultaneously moving the first core box section into engagement with the second joint face of the second core box section to form a second core member within the mold formed by the second joint face and the first core box section.

4. A system for making sand molds each having associated therewith a core member composed of a core element or a network of core elements comprising, in combination a. machine means for successively making and depositing onto a conveyor, mold sections with their joint faces in engagement to form a string of closed-up mold sections with mold cavities defined between adjacent mold sections and with the last mold section exposed preparatory to being engaged with a joint face of the next to be formed mold section, b. at least one core making machine positioned adjacent said string of closed-up mold sections said core making machine including at least two core box sections, each having a joint face and being arranged for mating of their joint faces for molding a core member therebetween, one of said core box sections retaining the mold core member when the joint faces of the core box sections are parted, said one core box section being adapted to be placed into an orientation such that its joint face is parallel with the exposed joint face of the last mold section, c. core mask means intermediate said machine means and said core making machine for removing the core member from the core making machine and transferring and inserting the core member to the last mold section, and d. translatory means operatively associated with said core mask means for moving the core mask means between a core picking up position where it engages with said one core box section while its joint face is parallel with the exposed joint face of the last mold section and a core delivery position where it engages the exposed joint face of the last mold.

5. A system according to claim 4 wherein the core making machine includes a plurality of core box sections.

6. A system according to claim 5 wherein two core box sections are fixed together and mounted for rotation and wherein each of the rotatably mounted two core box sections are adapted to retain the core member and by rotation be brought into engagement with the core mask.

7. A system according to claim 6 wherein said two core box sections are fixed together in back-to-back relationship and are arranged for rotation, a cooperating core box section being provided adjacent said fixed two core box sections, said cooperating core box section being arranged for alternative mating with said fixed two core box sections as said fixed core box sections are rotated.

8. A system according to claim 5 wherein a further core making machine is provided with the two core making machines being on different sides of the string of closed-up mold sections.

9. A system according to claim 8 wherein a separate core mask means intermediate said machine means and said further core making machine is provided for each core making machine.

10. A system according to claim 9 wherein each core masks means are coupled together.

11. A system according to claim 5 wherein a single core mask means cooperates with bore core making machines.

12. A system according to claim 4, characterized in that the core making machine has a plurality of core boxes which are so mounted on a rotatable support member that they can be placed successively in a position in which they are coaxial with the core mask in its receiving position, and in this position of the core box the two core box sections can be separated from each other by axial movement of one section to permit the core mask to be inserted between them.

13. A system according to claim 12, characterized in that the rotatable support member is a roundabout on which the core boxes are disposed with radially extending axes, and that the outermost core box section in the said position, in which the core box is capable of cooperating with the core mask, is axially displaceable.

14. A system according to claim 4, characterized in that the core making machine has two core boxes comprising two spaced apart coaxial stationary core box sections with moulding cavities facing each other and one core box section movable between the said two sections and with moulding cavities in the two surfaces facing their respective stationary sections.

15. A system for making sand molds each having associated therewith a core member composed of a core element or a network of core elements comprising, a. a mold section machine means for making mold sections having parallel joint faces with mold cavities in each joint face, and for consecutively depositing each of the mold sections onto a conveyor such that the joint faces of each mold section are in engagement with an adjacent mold section to form a string of mold sections, b. at least one core making machine positioned adjacent said string of mold sections comprising a first and second core box section, each core box section having a joint face with a cavity therein, first moving means for moving said first and second core box sections into mating engagement such that the cavities form a mold, means for molding a core member within said mold formed by said core box sections, separating means for separating said core box sections while retaining said core member within said second core box section, positioning means for positioning said second core box section such that its joint face is parallel with the joint face of the last deposited mold section, c. a core mask intermediate said mold section machine and said core making machine for removing the core from the core making machine, holding the core during transfer to the string of mold sections and inserting and releasing a core member into the last deposited mold section, d. second moving means operatively associated with said core mask for moving said core mask into engagement with said second core box section when said second core box section is positioned such that its joint face is parallel with the joint face of the last deposited mold section, and for obtaining the core member from said second core box section, e. transferring means operatively associated with said core mask for transferring said core mask to said last mold section, f. third moving means operatively associated with said core mask for moving said core mask into engagement with the joint face of the last deposited mold section and for depositing said core member in the mold cavity of said last deposited mold section.

16. The system of claim 15 wherein said second core box section comprises first and second joint faces with cavities therein, said first and second joint faces mounted in back-to-back relationship and parallel to each other, a rotatable shaft positioned between said first and second joint faces, and rotating means operatively associated with said shaft for rotating said shaft such that said first and second joint faces are rotated thereby.

17. The system of claim 16 wherein said first core box section is positioned adjacent said core box section, said first moving means further comprises means for moving said first core box section alternately into engagement with said first and second joint faces of said second core box section, said rotating means further comprises means for rotating said rotatable shaft at 180° increments such that said first and second joint faces of said second core box section are alternately parallel with said first core box section.

* * * * *